United States Patent [19]

Braithwaite et al.

[11] 4,431,326

[45] Feb. 14, 1984

[54] PAINT APPLICATOR AND CONTAINER

[75] Inventors: John D. Braithwaite; Derrick O. King, both of Berkshire; Sidney J. Williams, Surrey; James Prior, Berkshire, all of England

[73] Assignees: Black & Decker Inc.; Berger, Jensen & Nicholson, Ltd., both of Newark, Del.

[21] Appl. No.: 309,600

[22] Filed: Oct. 8, 1981

[30] Foreign Application Priority Data

Oct. 8, 1980 [GB] United Kingdom ..... 8032485

[51] Int. Cl.[3] ..... B05C 17/00; B05C 21/00

[52] U.S. Cl. ..... 401/188 R; 222/396; 222/397; 222/399; 220/70; 220/254; 220/306; 401/146; 401/187

[58] Field of Search ..... 401/187, 188 R, 146; 239/309, 373; 222/399, 183, 325, 397; 272/396, 399; 220/70, 254, 306

[56] References Cited

U.S. PATENT DOCUMENTS

| | | | |
|---|---|---|---|
| 2,160,043 | 5/1939 | Threm | 222/399 |
| 2,690,278 | 9/1954 | Bacheller | 222/325 X |
| 2,753,080 | 7/1956 | Bartlett | 222/396 X |
| 2,790,475 | 4/1957 | Close | 220/254 X |
| 2,829,801 | 4/1958 | Ayres | 239/309 |
| 3,006,515 | 10/1961 | Midnight | 222/396 |
| 3,021,976 | 2/1962 | Tracy | 220/254 X |
| 3,317,089 | 5/1967 | Kopczynski | 222/399 X |
| 3,352,457 | 11/1967 | Tracy et al. . | |
| 3,516,571 | 6/1970 | Roper et al. | 220/70 X |
| 3,558,010 | 1/1971 | Zenger . | |
| 3,572,540 | 1/1969 | LaCroce | 220/254 |
| 3,603,694 | 9/1971 | Hamm . | |
| 3,640,630 | 2/1972 | Walker | 401/188 |
| 3,672,547 | 6/1972 | Kozlowski | 220/254 X |
| 3,676,010 | 7/1972 | Kirch | 401/188 |
| 3,776,645 | 12/1973 | Walker | 401/188 |
| 3,861,564 | 1/1975 | Loeffler . | |
| 3,871,541 | 3/1975 | Adomaitis | 220/70 X |
| 3,895,736 | 7/1975 | Swett | 220/306 |
| 4,003,505 | 1/1977 | Hardt | 222/397 |

FOREIGN PATENT DOCUMENTS

| | | | |
|---|---|---|---|
| 1449554 | 8/1966 | France . | |
| 2006896 | 1/1970 | France . | |
| 2109072 | 5/1972 | France . | |
| 2216777 | 8/1974 | France . | |
| 2301306 | 9/1976 | France . | |
| 847353 | 9/1960 | United Kingdom | 222/399 |
| W080/00315 | 3/1980 | PCT Int'l Appl. . | |

*Primary Examiner*—Steven A. Bratlie

*Attorney, Agent, or Firm*—Edward D. Murphy; Harold Weinstein

[57] ABSTRACT

A liquid container containing liquid, such as paint, to be applied to a surface includes a radially inwardly facing sealing wall on the top of the container extending in a complete circle around the center of the container. An aperture is provided in the top of the container inside the sealing wall. The sealing wall has a depth of at least 4 mm and there is a free space projecting at least 4 mm radially inwardly of the sealing wall and extending in a complete circle around the inside of the sealing wall. In use the container is housed in an outer vessel, a conduit passes through the outer vessel and the top of the container to the bottom of the container, and a pressurizing assembly is provided for applying pressure inside the container. The outer vessel includes a circular seal member mounted on a radially outwardly facing wall extending downwardly from the top of the vessel and cooperating with the sealing wall on the liquid container.

8 Claims, 6 Drawing Figures

PAINT APPLICATOR AND CONTAINER

FIELD OF THE INVENTION

This invention relates to apparatus for use in the application of a liquid to a surface. In particular the invention relates to a liquid container and also to an apparatus for feeding liquid to an applicator, the apparatus including a liquid container which in use is inserted inside an outer vessel. The invention has particular reference to the application of paint.

BACKGROUND OF THE INVENTION

It has been proposed to feed liquid to an applicator with an apparatus consisting of an inner liquid container in which the liquid may be supplied to the user and an outer pressure vessel. Although the provision of an inner and outer container may at first sight seem unnecessary, such a two container system has been found to possess various advantages: for example, it makes the system cleaner to use and it makes cleaning of the system after use easier.

In our International patent application, publication No. WO 80/00315, an apparatus for applying liquid to a surface is described. In one of the embodiments described the apparatus has an inner paint container and an outer pressure vessel. In use pressurized gas is injected into the interior of the outer vessel and passes into the inner paint container and expels paint from the inner container through a dip tube to an applicator connected to the apparatus by a flexible tube. It is proposed that paint is supplied to the user in the inner paint container which the user inserts into the outer vessel before use. Since it is proposed that the paint be supplied to the user in the inner paint container, it is important that this container be of relatively simple and cheap construction.

In U.S. Pat. No. 3,640,630 a paint applicator is described in which a portable pressurized container is provided into which a paint container in the form of a flexible plastics bag may be inserted. In order to regulate the pressure in the container, the container forms a seal with a wall of an outer vessel and when the pressure exceeds a threshold value, the seal is broken until the pressure returns to below the threshold value.

We have found that, in order to ensure satisfactory feeding of the paint to the applicator and satisfactory application by the applicator, the paint should possess special physical properties. It is therefore desirable that the apparatus be able to be used only with paint which has been designed specifically for use with the apparatus. The use of an unsuitable liquid may also damage the apparatus.

With the apparatus of U.S. Pat. No. 3,640,630, it would be possible for a user to take a conventional can of paint, remove the lid and place the can in the outer container, or alternatively pour paint into the outer container. The apparatus could then be operated in the usual manner using the conventional paint.

Similarly, in the embodiment of our International patent application described above, it would be possible for a user to place a conventional paint can, instead of the inner paint container containing special paint, inside the outer vessel, or alternatively pour paint into the outer vessel. The apparatus therefore also has the disadvantage that it can be used with unsuitable paint. Although there is a reference in International patent application No. WO 80/00315 to providing means for preventing the insertion of an unsuitable container this would not prevent paint being poured directly into the outer vessel.

Various pressurizing assemblies for use in feeding liquid to an applicator are known. Our international patent application, publication No. WO 80/00315, published Mar. 6, 1980, describes and shows in FIG. 3 thereof a particular form of such pressurizing assembly, our British patent application, publication No. 2,066,932, published July 5, 1981, describes other suitable forms of pressurizing assembly, and both these descriptions are hereby incorporated herein by reference.

SUMMARY OF THE INVENTION

It is an object of the invention to provide a container and apparatus that overcomes at least in part the problems described above.

According to a first aspect of the invention there is provided a paint container containing paint and including a radially inwardly facing sealing wall on the top of the container extending in a complete circle around the center of the container, and aperture defining means on the top of the container inside the sealing wall, the sealing wall having a depth of at least 4 mm and there being a free space projecting at least 4 mm radially inwardly of the sealing wall and extending in a complete circle around the inside of the sealing wall.

The provision of a sealing wall on the paint container enables the apparatus to be arranged such that when the container is placed inside an outer vessel, a seal is made between the sealing wall on the paint container and the outer vessel. By ensuring that this seal has to be made in order for the apparatus to operate, it is ensured, in a simple manner, that the apparatus is used only with the intended paint container having the sealing wall, and therefore that the apparatus is used only with the proper paint, unless extraordinary measures are taken by a user. By making the sealing wall face radially inwardly the risk of damage to the sealing wall is minimized. Since the sealing wall has a depth of at least 4 mm it is possible to make a good seal with the wall. The provision of a free space projecting at least 4 mm radially inwardly of the sealing wall allows sufficient space for the cooperating seal of the outer vessel to make a good seal with the sealing wall.

While many cylindrical containers of liquid other than paints have rims at their ends, within one of which rims there is aperture defining means, such rims do not provide the inwardly facing sealing surface required by a paint container embodying the present invention. Such rims are purely constructional components formed during the fabrication of the container.

According to a second aspect of the invention there is provided a paint container containing paint, the interior of which is to be pressurized in order that paint may be expelled from the container through a dip tube, the container having on its top a radially inwardly facing sealing wall extending in a complete circle around the center of the container for sealing against a circular seal member mounted on a radially outwardly facing wall extending downwardly from above the container and in confronting relationship with the sealing wall, the sealing wall having a depth of at least 4 mm and there being a free space projecting at least 4 mm radially inwardly of the sealing wall and extending in a complete circle around the inside of the sealing wall, the free space being provided for accommodating the circular seal member and the radially outwardly facing wall extending downwardly from above the container, there being aperture defining means on the top of the container inside the sealing wall through which a dip tube is to be inserted from above.

The diameter of the inwardly facing sealing wall may be approximately 98 mm.

The paint container defined in the paragraph immediately above is specifically designed for use with the type of apparatus described with reference to the drawings of this specification.

The paint container may have an internal volume of about one liter.

The paint container may have a container body and a lid on which the sealing wall is provided, there being a gas tight seal between the body and the lid, and the body and the lid being inseparable, or difficult to separate, by a user, at least, without the aid of a tool. By making the container in two parts filling of the container and manufacture of the container is facilitated. It is preferable that the body and the lid be inseparable by a user without the aid of a tool so that the user cannot fill up the paint container with unsuitable paint or place a can of unsuitable paint inside the paint container.

The aperture defining means may define a passage having a transverse cross-sectional area covering less than one percent of the maximum transverse cross-sectional area of the container. By making the passage small spillage of paint from the container is inhibited and the refilling of the container by a user with unsuitable paint is also inhibited.

Preferably the passage has a substantially circular transverse cross-section of diameter about 7 mm. This is substantially the same as the diameter of a dip tube of the particular apparatus shown in the drawings of this specification so that if the paint container is used in that particular apparatus, there is substantially no leakage of paint from the container during use, even if the apparatus is inverted and when, after use, the dip tube is withdrawn from the container, the dip tube is wiped by the passage wall. In order to enhance the wiping action the wall of the container surrounding the dip tube is preferably flexible.

The aperture defining means may comprise an aperture in the container or a weakened portion of the container wall which may be removed by a user prior to use. A plug may be provided for closing the aperture.

The base of the container may be provided with a deformable support deformable in response to a force on the base of the container exceeding a threshold value. The deformable support may comprise a plurality of radially extending thin webs each lying in a plane which is vertical when the container is in an upright position. The container can be supported on these webs and, if the pressure in the container exceeds a safe value, the force on the base of the container exceeds the threshold value, the webs deform and the container moves breaking the seal with the outer vessel. Preferably the webs are made permanently deformable and the container cannot be used after such a malfunctioning of the apparatus, but alternatively the webs may be resiliently deformable.

The interior of the container may be provided with a well in its bottom. This enables almost all of the paint to be extracted from the container.

The container may be made of a plastics material.

According to a third aspect of the invention, there is provided an apparatus for feeding paint to an applicator, the apparatus including an outer vessel, a paint container housed in the outer vessel, a paint conduit passing through the outer vessel and the top of the paint container to the bottom of the paint container, and means for applying pressure inside the paint container, the outer vessel including a circular seal member mounted on a radially outwardly facing wall extending downwardly from the top of the vessel, wherein the paint container is as defined above and the sealing wall seals against the circular seal member.

Apparatus of the kind defined in the paragraph immediately above can only be used with its intended liquid container and therefore its intended liquid, unless a user goes to extreme lengths. The provision of an outer, substantially unpressurized, vessel around the liquid container makes the apparatus extremely safe since even if the liquid container fails to withstand the pressure within it and bursts, the outer vessel will retain the burst container.

The base of the liquid container is preferably supported by the outer vessel; in this way the side wall of the liquid container does not have to withstand longitudinal stress but only hoop stress.

The container may be clamped in the outer vessel between its base and the rim of the top or lid of the container. This alleviates stress on the rim of the top or lid of the container, when in use the container is pressurized.

The apparatus may include a pressurizing assembly for supplying pressurized gas to the inlet of the liquid container, the pressurizing assembly including a housing for receiving a capsule of pressurized gas and pressure reducing means.

The apparatus may also include an applicator connected to the outlet of the paint conduit for applying the paint to a surface, the paint conduit including a flexible tube extending from the outer vessel to the applicator.

According to a fourth aspect of the invention there is provided a liquid container containing liquid to be applied to a surface and including a radially inwardly facing sealing wall on the top of the container extending in a complete circle around the center of the container, and aperture defining means on the top of the container inside the sealing wall, the sealing wall having a depth of at least 4 mm and there being a free space projecting at least 4 mm radially inwardly of the sealing wall and extending in a complete circle around the inside of the sealing wall.

According to a fifth aspect of the invention there is provided a liquid container containing liquid to be applied to a surface, the interior of which is to be pressurized in order that liquid may be expelled from the container through a dip tube, the container having on its top a radially inwardly facing sealing wall extending in a complete circle around the center of the container for sealing against a circular seal member mounted on a radially outwardly facing wall extending downwardly from above the container and in confronting relationship with the sealing wall, the sealing wall having a depth of at least 4 mm and there being a free space projecting at least 4 mm radially inwardly of the sealing wall and extending in a complete circle around the inside of the sealing wall, the free space being provided for accommodating the circular seal member and the radially outwardly facing wall extending downwardly from above the container, there being aperture defining means on the top of the container inside the sealing wall through which a dip tube is to be inserted from above.

Even when the liquid in the container is not paint it can be important that only the correct liquid is fed in the apparatus. For example, it may be desirable to provide a container containing wood preservative and in this case it would be important to ensure that the wood preservative did not contain any constituents that might damage the liquid feeding apparatus.

BRIEF DESCRIPTION OF THE DRAWINGS

By way of example an embodiment of the invention will now be described with reference to the accompanying drawings, of which.

DETAILED DESCRIPTION OF THE PREFERRED EMBODIMENT

Figure 1:
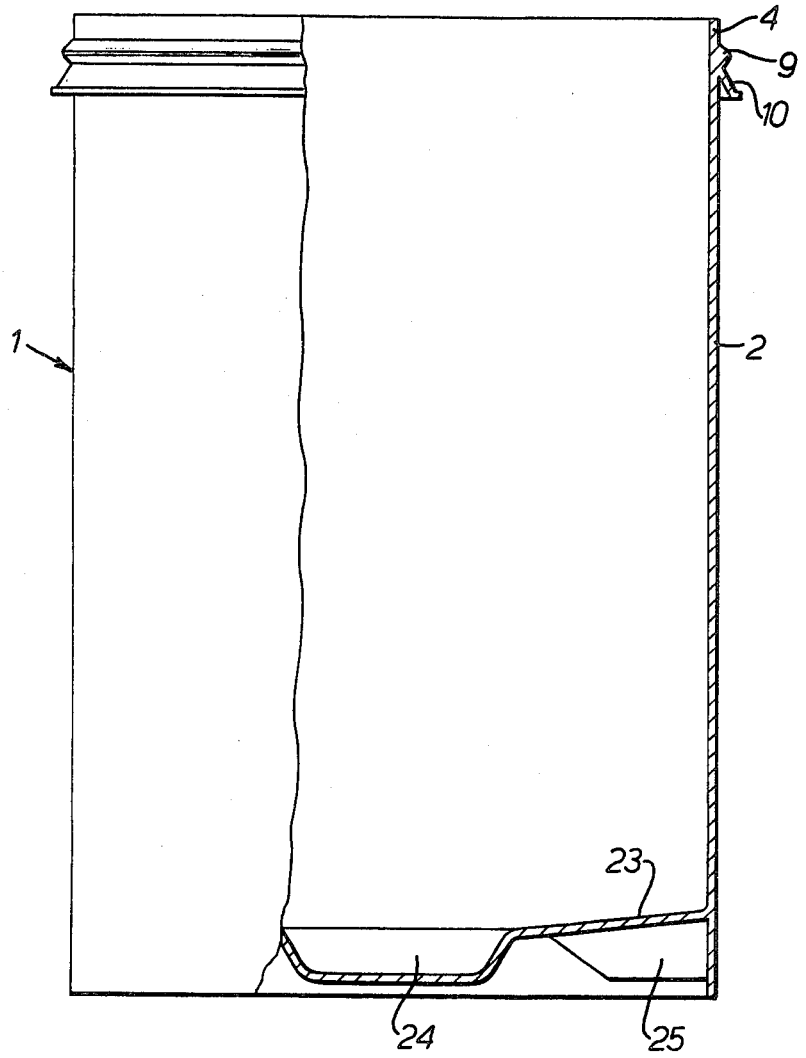
FIG. 1 is partly sectional side view of a paint container without its lid.

Referring first to FIGS. 1 to 5, a paint container 1 having an internal volume of just over a liter made of plastics material and of circular cross-section has a body 2 and a lid 3. The lid 3 fits over the rim 4 of the top of the container body 2 and has a radially inwardly facing smooth sealing wall 5 extending in a complete circle of diameter 97.6 mm (within a tolerance of ±0.2 mm) around the center of the container. A recess 6 is formed in the lid inwardly of the sealing wall 5.

The lid 3 has a resilient downwardly extending flange 7 formed with a protuberance 8 which engages under a corresponding protuberance 9 formed on the outside of the container body. Below the protuberance 9 the container body has a downwardly inclined flange 10 terminating in an outwardly projecting lip 11. The lip 11 and flanges 7 and 10 of the lid and container body are shaped such that they together define a substantially continuous outline to the container. This enhances the appearance of the container and also impedes removal of the lid from the container.

Figure 2:
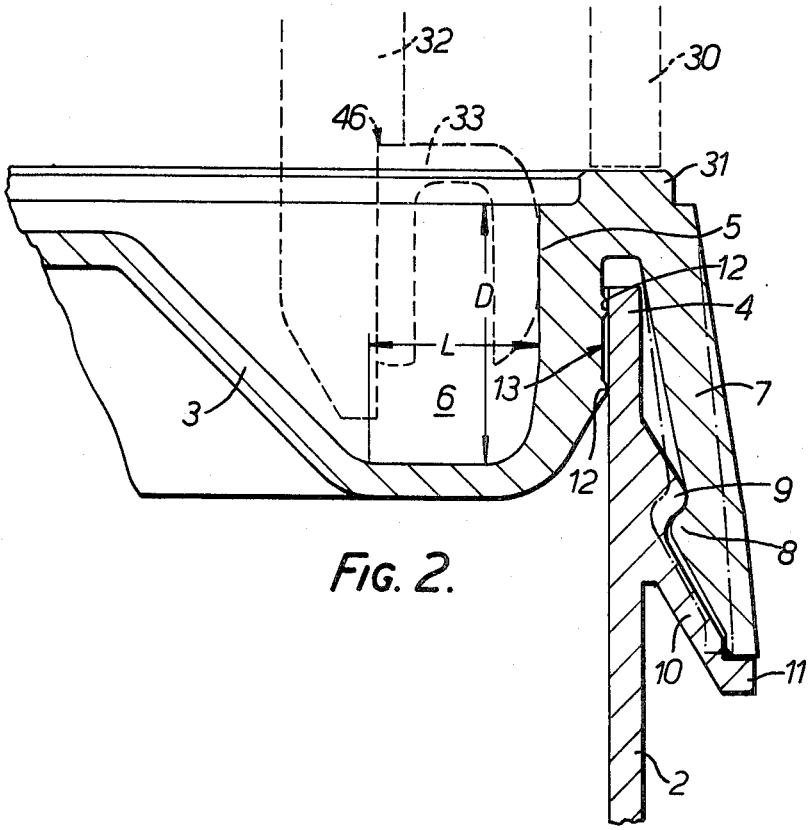
FIG. 2 is a sectional side view of part of the container of FIG. 1 showing the junction of the lid and the container.

The natural unstressed position of the flange 7 of the lid is approximately as shown in chain dotted outline in FIG. 2, but when the lid 3 is forced over the rim of the container, the flange 7 is flexed outwardly to the position shown. A pair of circumferential ribs 12, formed on the face 13 of the lid 3 which engages the inside of the container body 2, press against the container body and seal the lid to the body.

Figure 3:
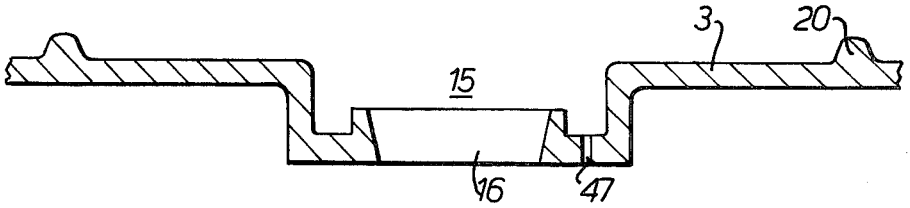
FIG. 3 is a sectional side view of the center portion of the lid of the container.
Figure 4:
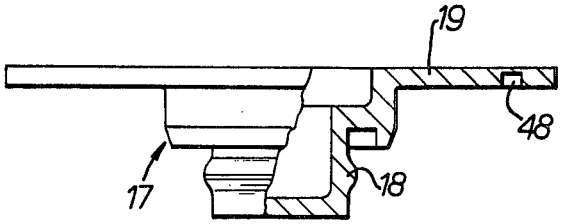
FIG. 4 is a partly sectional side view of a closure plug for the container.
Figure 5:
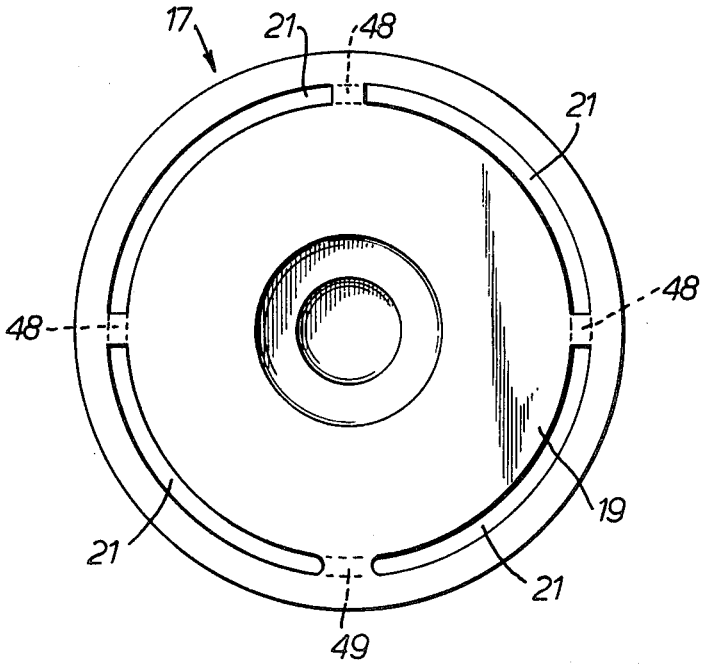
FIG. 5 is a plan view of the plug of FIG. 4.

As shown in FIG. 3, the lid 3 has a central recess 15 in which an aperture 16 is provided, the aperture being sized to receive a plug 17, shown in FIGS. 4 and 5. When the plug 17 is fitted into the aperture 16, a protuberance 18 on the plug engages under the lower edge of the aperture 16 and the disc-shaped top 19 of the plug lies within the circular area defined by a rib 20 on the lid 3.

The plug 17 has a "ring pull" top. Four circumferential slots 21 are formed in the top 19 and these are joined by deep grooves 48 in the underside of the top. No groove is provided between two of the slots and this ungrooved portion defines a bridging web 49. Accordingly when, for the first time, a user lifts the edge of the top 19, the material tears at the three deep grooves 48 so that the outside of the top forms a ring by which a user may pull the plug out of the aperture 16.

Referring again to FIG. 1, the container body 2 has a transverse sloping bottom wall 23 that slopes downwardly to a well 24 at the centre of the container. Beneath the bottom wall 23 are twelve equiangularly spaced thin webs 25. Each web 25 extends radially inwardly from the peripheral wall of the container body 2 and is disposed in a vertical plane.

Figure 6:
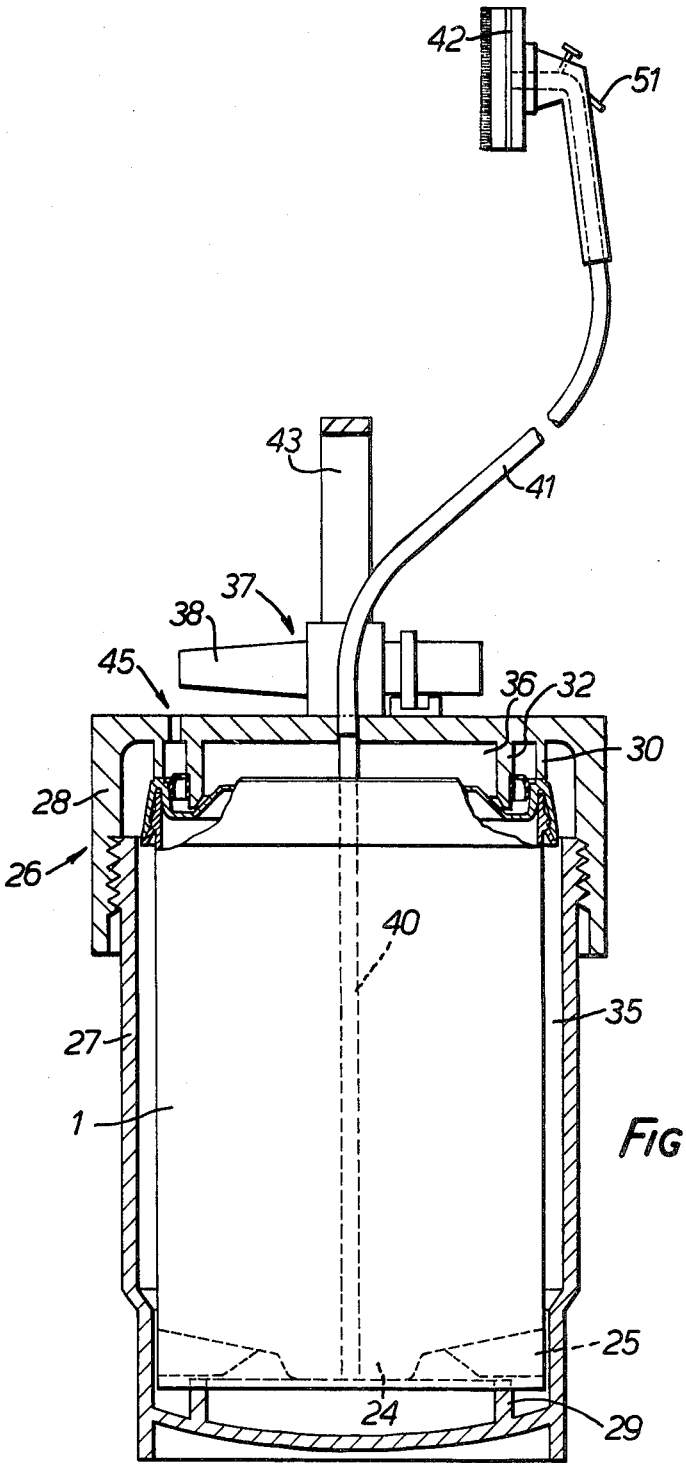
FIG. 6 is a partly sectional side view of a painting apparatus incorporating the container of FIGS. 1 to 5.

FIG. 6 shows the container 1 installed in a painting apparatus incorporating the container of FIGS. 1 to 3. The container 1, which is shown in sectional outline in FIG. 6, is placed in an outer vessel 26 which has a body 27 and a lid 28. At the bottom of the interior of the vessel 26 an annular rib 29 is provided on which the webs 25 sit edgewise supporting the container. The lid 28 of the vessel has a downwardly extending annular rib 30 which, when the lid 28 of the vessel is screwed fully onto the body 27, bears down on a raised portion 31 (see also FIG. 2) of the container. Thus the container 1 is clamped in the outer vessel between its base and the rim of the lid of the container.

Another annular rib 32 inside the rib 30 extends downwardly from the lid 28 of the vessel and a seal member 33 of inverted 'U' shaped cross-section is secured around the outside of the rib 32. The distal limb of the 'U' of the seal member 33 engages the sealing wall 5 of the container. FIG. 2 shows the ribs 30, 32 and seal member 33 in dotted outline and it will be seen that the recess 6 accommodates the rib 32 and seal member 33. The depth of the sealing wall and the size of the recess 6 are chosen so as to provide an efficient seal. In this particular example of the invention the sealing wall 5 has a depth 'D' of 5 mm, (in another example the depth 'D' is 7.5 mm), and there is a free space projecting a distance 'L' of 5.1 mm radially inwardly of the sealing wall. The seal member 33 divides the space between the container 1 and the outer vessel 26 into a lower chamber 35 and an upper chamber 36.

A pressurizing assembly 37 is mounted on the lid 28 of the outer vessel and has an outlet (not shown) which passes through the lid 28 into the chamber 36. The pressurizing assembly 37 includes a housing 38 containing a capsule of pressurized gas and pressure reducing means in the gas flow path from the capsule to the chamber 36 for reducing the gas pressure from the capsule pressure which may be several hundred pounds per square inch to for example ten pounds per square inch. A particular form of pressurizing assembly that may be used is that shown in FIG. 3 of our International patent application, publication No. WO 80/00315. Other suitable forms of pressurizing assembly are described in our British patent application, publication No. 2,066,932.

Sealingly mounted in an aperture in the centre of the lid 28 is the top of a dip tube 40 which extends through the chamber 36, through the aperture 16 (shown in FIG. 3) in the container and down into the well 24 at the bottom of the container. A flexible tube 41, which in this example is of internal diameter 5 mm, is connected to the dip tube in the lid 28 and extends to an applicator 42 the design of which is not a significant part of the present invention and will not be described further. The tube 41 and the dip tube together have a length of about 1.4 mm.

A handle 43 of inverted 'U' shape is connected to diametrically opposite portions of the side of the lid 28 of the vessel, and a clip (not shown) is provided on one side of the handle to allow a user to clip the vessel to a belt or waistband.

Paint is purchased by a user in the container 1. The container body 2 is filled at the factory with a liter of paint and the lid 3 is then secured to the body 2 with the plug 17 fitted in the aperture 16; if desired, the plug may be sealed to the lid 3.

When the user wishes to use the apparatus, he removes the plug 17 from the aperture 16 and places the container 1 in the vessel body 27. He then takes the lid 28 of the outer vessel, together with the dip tube 40, flexible tube 41, applicator 42, handle 43 and pressurizing assembly 37 and inserts the dip tube 40 through the aperture 16, in which it is a close fit, and screws the lid 28 onto the vessel body 27. In so doing the rib 30 on the lid is brought into engagement with the raised portion 31 on the container and the seal member 33 seals against the sealing wall 5 on the container.

In order to operate the device, the user adjusts the pressurizing assembly 37 allowing pressurized gas to pass into the chamber 36 from which the gas passes into the container 1 through an aperture 47 (FIG. 3) in the lid 3 of the container. As can be seen from FIG. 3, the aperture 47 is substantially smaller than the dip tube aperture 16 and is located in a channel surrounding the aperture 16. Paint is expelled through the dip tube 40 and passes through the flexible tube 41 where it is applied to a surface by an applicator, 42, which may be a pad, roller or brush, the applicator including control means 51 to control the flow of paint from the applicator.

When the user has finished painting he adjusts the pressurizing assembly 37 to the =off" position, unscrews the lid 28 of the outer vessel, removes the dip tube 40 from the container 1 and replaces the plug 17 in the aperture 16 provided there is still some paint in the container 1. As the dip tube is removed from the container the wall of the aperture 16 wipes excess paint off the dip tube. In order to enhance the wiping action the dimensions of the lid around the aperture are chosen so that this part of the container wall is flexible. The only parts that require cleaning after use are the tubes 40, 41 and the applicator 42. Even if the apparatus is inverted during use, paint does not leak out of the container into the vessel.

Should the user attempt to use a can of conventional paint in place of the container 1 or pour paint directly into the outer vessel, the seal member 33 will not make a seal and pressurized gas entering the outer vessel will pass out of the vessel through the junction between the lid 28 and the vessel body 27 and also through one or more apertures 45 in the lid of the outer vessel. Furthermore the lid 3 is attached so securely to the body 2 of the container that it cannot be readily detached by a user without the aid of a tool so that it is difficult for the user to refill the container 1. The aperture 16 is so small that refilling the container through this aperture would be a difficult and laborious process.

Should the pressure reducing means of the pressurizing assembly malfunction leading to an increase in pressure in the chamber 36 and the container 1, the seal member 33 is forced upwardly past a shoulder 46 (shown in FIG. 2) formed on the rib 32 and blown into the space between the ribs 32 and 30. The pressurized gas is then able to escape the atmosphere through the one or more apertures 45. Even if the seal member remains in place there is yet another safety feature, namely that the pressure of gas pressing down on the container 1 becomes sufficient for the webs 25, on which the container sits, to be crushed causing the container to move down inside the vessel and move out of engagement with the seal member 33.

Thus it will be seen that quite apart from any safety devices incorporated in the pressurizing assembly there are two distinct safety mechanisms provided in the coupling of the container and the outer vessel. Furthermore, even if the container were to burst, perhaps because of faulty manufacture of the container, the container and its contents will be confined within the outer vessel.

The use of an apparatus including an inner liquid container and an outer vessel at least a portion of which is not pressurized is of value not only where the application of paint is concerned but also in the application of other liquids. Although the provision of the outer vessel might appear unnecessary as the outer vessel is unpressurized, it does considerably improve the safety of the apparatus as described above.

The design of the container 1 with the sealing wall 5 is particularly significant in the case of a paint container, since only suitable paint should be used in a pressurized paint feed system, and the provision of the sealing wall 5 on the paint container means that only this sort of container and therefore the kind of paint in that container can be used.

While in the embodiment shown in the drawing the central portion of the lid 3 is raised, it will be understood that the lid 3 could extend straight across the container at constant depth D below the top of the container. The particular form of plug closure shown in the drawings has a "ring pull" top, but it will be appreciated that there are a variety of forms of closure that could be used. If desired a pressure indicator, either indicating the actual pressure in the vessel and container, or merely indicating whether or not the vessel is pressurized may be provided.

It may be desirable to make the rib 30 discontinuous and also to provide the one or more apertures 45 in the body of the vessel. This ensures that the seal member 33 cannot reseal once it has been blown off; the discontinuities in the rib 30 provide a venting path to atmosphere once the seal member has blown off.

A suitable paint for the system comprises film-forming resin together with pigment and/or extender in an aqueous medium, and having an efflux time viscosity, measured as the time required to pump 100 ml through a tube of internal diameter 5 mm and length about 1.4 m under conditions defined therein:

| Temp. (°C.) | Pressure (gauge) (kPa) | Pre-treatment | Permitted efflux time (seconds) |
|---|---|---|---|
| 20 | 69 | Storage overnight | about 40 to about 100 |
| 5* | 69 | Storage overnight | not more than about 120 |
| 30 | 69 | Storage overnight | not less than about 35 |
| 20 | 62 | Storage overnight | not more than about 120 |
| 20 | 103 | Storage overnight | not less than about 20 |
| 20 | 69 | Storage 3 Months | about 40 to about 100 |

-continued

| Temp. (°C.) | Pressure (gauge) (kPa) | Pre-treatment | Permitted efflux time (seconds) |
|---|---|---|---|
| 20 | 69 | 7 Freeze-thaw cycles | about 40 to about 100 |

*gloss paints tested at 10° C.

What is claimed is:

1. An apparatus for feeding liquid to an applicator, comprising:

an outer vessel having a body and a lid;

a liquid container housed in the outer vessel and having a cover, a base, and a central axis;

a liquid conduit extending into the outer vessel and through the container cover to the bottom of said container, said conduit being connected, in use, to the applicator;

means for applying pressure inside the liquid container to feed liquid to the applicator;

a radially outwardly facing wall extending downwardly inside said vessel from said vessel lid, said outwardly facing wall being spaced radially inwardly from said vessel body;

a circular seal member mounted around the outside of said outwardly facing wall;

said cover having a recess in the top thereof, the outer periphery of said recess being defined by a radially inwardly facing sealing wall on the exterior of said cover and extending in a complete circle around said central axis;

said outwardly facing wall being spaced radially inwardly of said sealing wall and locating said circular seal member in sealing engagement with said sealing wall;

said inwardly facing sealing wall having a depth of at least 4 mm, and said recess extending at least 4 mm radially inwardly of the sealing wall and extending completely around the inside of said sealing wall to accommodate said circular seal member;

said liquid conduit extending through said container cover inside said sealing wall;

said cover having an upwardly extending rim radially outwardly of said inwardly facing sealing wall; and said vessel lid having a second downwardly extending wall spaced radially outwardly of and surrounding said outwardly facing wall, said second downwardly extending wall engaging on the top of said rim to clamp said container in said outer vessel.

2. An apparatus for feeding liquid to an applicator, comprising:

an outer vessel having a body and a lid;

a liquid container housed in the outer vessel and having a cover, a base, and a central axis;

a liquid conduit extending into the outer vessel and through the container cover to the bottom of said container, said conduit being connected, in use, to the applicator;

means for applying pressure inside the liquid container to feed liquid to the applicator;

a radially outwardly facing wall extending downwardly inside said vessel from said vessel lid, said outwardly facing wall being spaced radially inwardly from said vessel body;

a circular seal member mounted around the outside of said outwardly facing wall;

said cover having a recess in the top thereof, the outer periphery of said recess being defined by a radially inwardly facing sealing wall on the exterior of said cover and extending in a complete circle around said central axis;

said outwardly facing wall being spaced radially inwardly of said sealing wall and locating said circular seal member in sealing engagement with said sealing wall;

said inwardly facing sealing wall having a depth of at least 4 mm, and said recess extending at least 4 mm radially inwardly of the sealing wall and extending completely around the inside of said sealing wall to accommodate said circular seal member;

said liquid conduit extending through said container cover inside said sealing wall; and said base comprising a deformable portion upon which the container is supported by said body of the vessel, said deformable portion yielding when the downward force on said base exceeds a threshold value resulting in said sealing wall moving downwardly out of sealing engagement with said circular seal member.

3. An apparatus for feeding liquid to an applicator, comprising:

an outer vessel having a body and a lid;

a liquid container housed in the outer vessel and having a cover, a base, and a central axis;

a liquid conduit extending into the outer vessel and through the container cover to the bottom of said container, said conduit being connected, in use, to the applicator;

means for applying pressure inside the liquid container to feed liquid to the applicator;

a radially outwardly facing wall extending downwardly inside said vessel from said vessel lid, said outwardly facing wall being spaced radially inwardly from said vessel body;

a circular seal member mounted around the outside of said outwardly facing wall;

said cover having a recess in the top thereof, the outer periphery of said recess being defined by a radially inwardly facing sealing wall on the exterior of said cover and extending in a complete circle around said central axis;

said outwardly facing wall being spaced radially inwardly of said sealing wall and locating said circular seal member in sealing engagement with said sealing wall;

said inwardly facing sealing wall having a depth of at least 4 mm, and said recess extending at least 4 mm radially inwardly of the sealing wall and extending completely around the inside of said sealing wall to accommodate said circular seal member;

said liquid conduit extending through said container cover inside said sealing wall;

said base comprising a deformable portion upon which the container is supported, said deformable portion yielding when the downward force on said base exceeds a threshold value resulting in said sealing wall moving downwardly out of sealing engagement with said circular seal member;

said deformable portion comprising a plurality of deformable webs extending downwardly from the bottom of said container; and said vessel body having an annular rib projecting upwardly from the bottom thereof, said webs sitting edgewise on said annular rib and supporting said container thereon.

4. A liquid container for use in an apparatus for dispensing liquid by means of pressurized gas, comprising:

a container body having a central axis and a closed base;

a plurality of thin deformable webs extending downwardly from said closed base and radially with respect to said central axis;

said container body having a top connected thereto in gas tight manner;

a rim around the periphery of said top;

a radially inwardly facing smooth sealing wall formed externally on said top and extending in a complete circle around said central axis internally of said rim, said sealing wall having a depth parallel to said central axis of at least 4 mm and there being a free space externally of the container projecting at least 4 mm radially inwardly of said sealing wall;

means, associated with said top radially inwardly of said sealing wall, for defining an aperture in said top for the insertion in use of a liquid dispensing dip tube therethrough;

whereby when, in use, said container is clamped in an outer vessel of the apparatus between said rim and said webs with a circular seal member of said vessel sealing against said sealing wall, said webs are deformable in response to a force on said base exceeding a threshold value to break the seal between said seal member and said sealing wall;

the uppermost portion of said container body forming a rim, said top being a lid having a resilient, downwardly extending, peripheral flange formed with a first protuberance engaged under a corresponding second protuberance formed on the outside of said container body, said container body rim being disposed radially outwardly of said sealing wall and sealingly engaging between said flange and said sealing wall;

said container body having a downwardly inclined flange below said first protuberance and terminating in an outwardly projecting lip; and said lip, said container body flange and said lid flange being shaped to define a substantially continuous outline to the container, whereby removal of said lid is impeded.

5. The liquid container of claim 4, wherein said sealing wall has two radially outwardly projecting ribs extending circumferentially therearound and engaging an inner surface of said container body rim.

6. The liquid container of claim 4, wherein said lid has a central recess therein spaced radially inwardly of said sealing wall, and said aperture defining means is a hole in said recess.

7. The liquid container of claim 6, wherein said recess has a channel therein around said hole, and said channel has an aperture therein, said aperture being substantially smaller in size than said hole.

8. The liquid container of claim 4, wherein said webs are permanently deformable.

* * * * *